US008240788B2

(12) United States Patent
Juan et al.

(10) Patent No.: US 8,240,788 B2
(45) Date of Patent: Aug. 14, 2012

(54) HIDDEN SELF-CLOSING DRAWER SLIDE ASSEMBLY

(75) Inventors: Teng-Yi Juan, Taipei (TW); Shih-Wang Chen, Taipei (TW)

(73) Assignee: Sun Chain Metal Industry Co., Ltd., Taipei (TW)

( * ) Notice: Subject to any disclaimer, the term of this patent is extended or adjusted under 35 U.S.C. 154(b) by 330 days.

(21) Appl. No.: 12/717,386

(22) Filed: Mar. 4, 2010

(65) Prior Publication Data

US 2011/0215690 A1 Sep. 8, 2011

(51) Int. Cl.
*A47B 88/04* (2006.01)

(52) U.S. Cl. ..... 312/333

(58) Field of Classification Search ..... 312/330.1, 312/319.1, 333, 334.1, 334.6, 334.7, 334.8, 312/334.27, 334.32; 384/21, 22
See application file for complete search history.

(56) References Cited

U.S. PATENT DOCUMENTS

| | | | | |
|---|---|---|---|---|
| 7,077,487 | B2 * | 7/2006 | Yang | 312/333 |
| 7,374,260 | B2 * | 5/2008 | Lu | 312/333 |
| 7,472,973 | B2 * | 1/2009 | Huang | 312/333 |
| 7,914,093 | B2 * | 3/2011 | Huang | 312/333 |

* cited by examiner

*Primary Examiner* — James O Hansen

(57) ABSTRACT

A hidden self-closing drawer slide assembly comprises a base, a pressure cylinder, a traction member and a spring. The traction member is movably received in the base. The traction member is provided with a guiding block. The base is formed with a slide groove, and one end of the slide groove is folded into a positioning portion. The guiding block guides the traction member to linearly moves in the slide groove, and slides through the slide groove and finally into the positioning portion, and the locking protrusion of the traction member will disengage from the concave locking portion of the pressure cylinder. The traction member will be pushed back by the spring to its original position, and the pressure cylinder provides a buffering effect to absorb the shock.

7 Claims, 9 Drawing Sheets

HIDDEN SELF-CLOSING DRAWER SLIDE ASSEMBLY

BACKGROUND OF THE INVENTION

1. Field of the Invention

The present invention relates to a hidden self-closing drawer slide assembly, which is used together with a slide rail of a drawer.

2. Description of the Prior Art

Drawers are common articles in daily life, and nowadays, many drawers are equipped with self-closing device. FIGS. 1A and 1B show a conventional self-closing drawer slide assembly which comprises: a base a, a traction member b, a spring c and a pressure cylinder d. The base a is provided with a rail a1 on which is movably disposed the traction member b in such a manner that the spring c and the pressure cylinder d are disposed between the traction member b and the base a. At the bottom surface of the traction member b is pivotally disposed a locking block b1 which is pulled by the traction member b and moves along the rail a1. The rail a1 is formed with a positioning concave a2, once the traction member b is pulled, the spring c will be stretched and the pressure cylinder d will also be pulled out by the traction member b, so that the locking block b1 will be pivoted into the positioning concave a2 and positioned therein. When the traction member b is subjected to a pushing force, the locking block b1 will disengage from the positioning concave a2, the spring c will push the traction member b back to its original position, and meanwhile, the pressure cylinder d will be pushed by the traction member b back to its original position. The traction member b moves linearly to make the locking block b1 pivot or rotate into or out of a locking position. The pressure cylinder d provides a buffering effect to buffer the motion of the traction member b, absorbing the impact and shock between the traction member b and the base a. The traction member b moves in sync with the spring c and the pressure cylinder d when being pulled out or pushed back, thus producing a function of self closing and buffering.

The present invention has arisen to mitigate and/or obviate the afore-described disadvantages.

SUMMARY OF THE INVENTION

The primary object of the present invention is to provide a hidden self-closing drawer slide assembly, which comprises a traction member moves linearly and pivotally so as to perform pulling, engaging and disengaging operations.

To achieve the above object, a hidden self-closing drawer slide assembly in accordance with the present invention is provided with a base, a pressure cylinder, a traction member and a spring. The base is formed with a receiving chamber for accommodation of the pressure cylinder and a slide groove in communication with the receiving chamber. One end of the slide groove away from the receiving chamber is folded into a positioning portion. One edge of the base is formed with a protruding hook. The pressure cylinder is received in the receiving chamber of the base and is provided with a retractable piston rod, and the piston rod is extended out of the pressure cylinder and is movably received in the slide groove. One end of the retractable piston rod extending out of the pressure cylinder is formed with a concave locking portion. The traction member includes a flat board formed with a driving portion. The driving portion includes a first restricting protrusion and a second restricting protrusion. Between the first and second restricting protrusions is a first locking space. The flat board includes a pin. On the flat board is disposed a guiding block, and the edge of the flat board adjacent to the guiding block extends outward to form a locking protrusion. The traction member is mounted on the base in such a manner that the guiding block is movably received in the slide groove of the base, and the locking protrusion is engaged in the locking portion of the piston rod of the pressure cylinder. The spring has two ends hooked to the hook of the base and the pin of the traction member.

The self-closing drawer slide assembly is used together with the drawer, since the guiding block of the traction member is movably received in the slide groove of the base, and the traction member moves linearly and pivotally, the guiding block of the traction member will slide through the slide groove and finally into the positioning portion, and the locking protrusion of the traction member will disengage from the concave locking portion of the pressure cylinder. When the user continues pushing the traction member, the traction member will be pushed back by the spring to its original position, and the locking protrusion of the traction member will be locked into the locking portion of the pressure cylinder, so as to provide a buffering effect to absorb the shock and noise.

DETAILED DESCRIPTION OF THE PREFERRED EMBODIMENTS

Figure 1A:
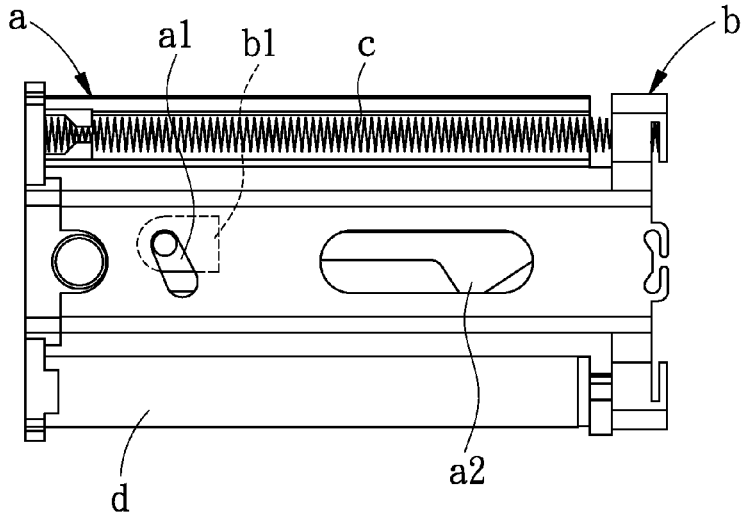
FIG. 1A PRIOR ART
FIG. 1A is a perspective view of a conventional self-closing drawer slide assembly.
Figure 1B:
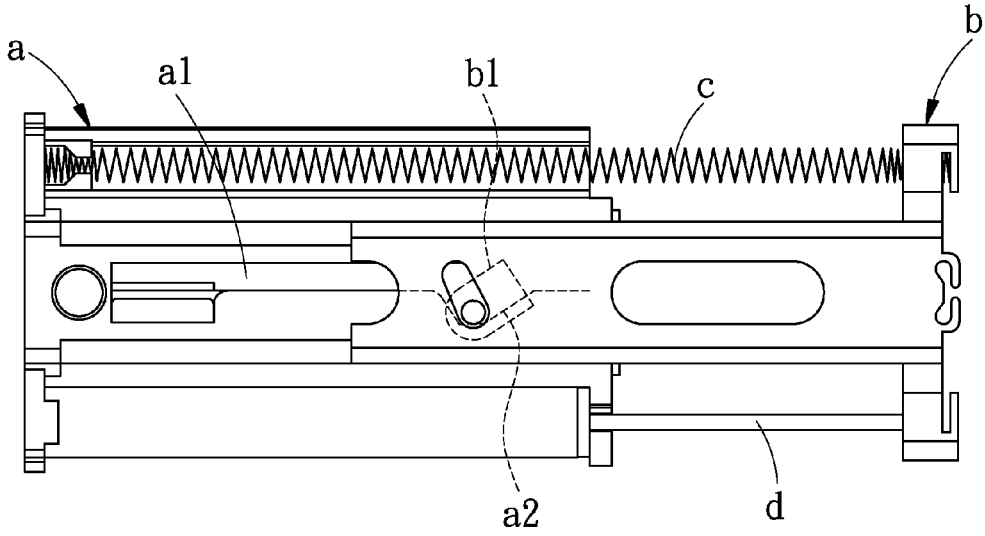
FIG. 1B PRIOR ART
FIG. 1B is an illustrative view showing the operation of the conventional self-closing drawer slide assembly.
Figure 2:
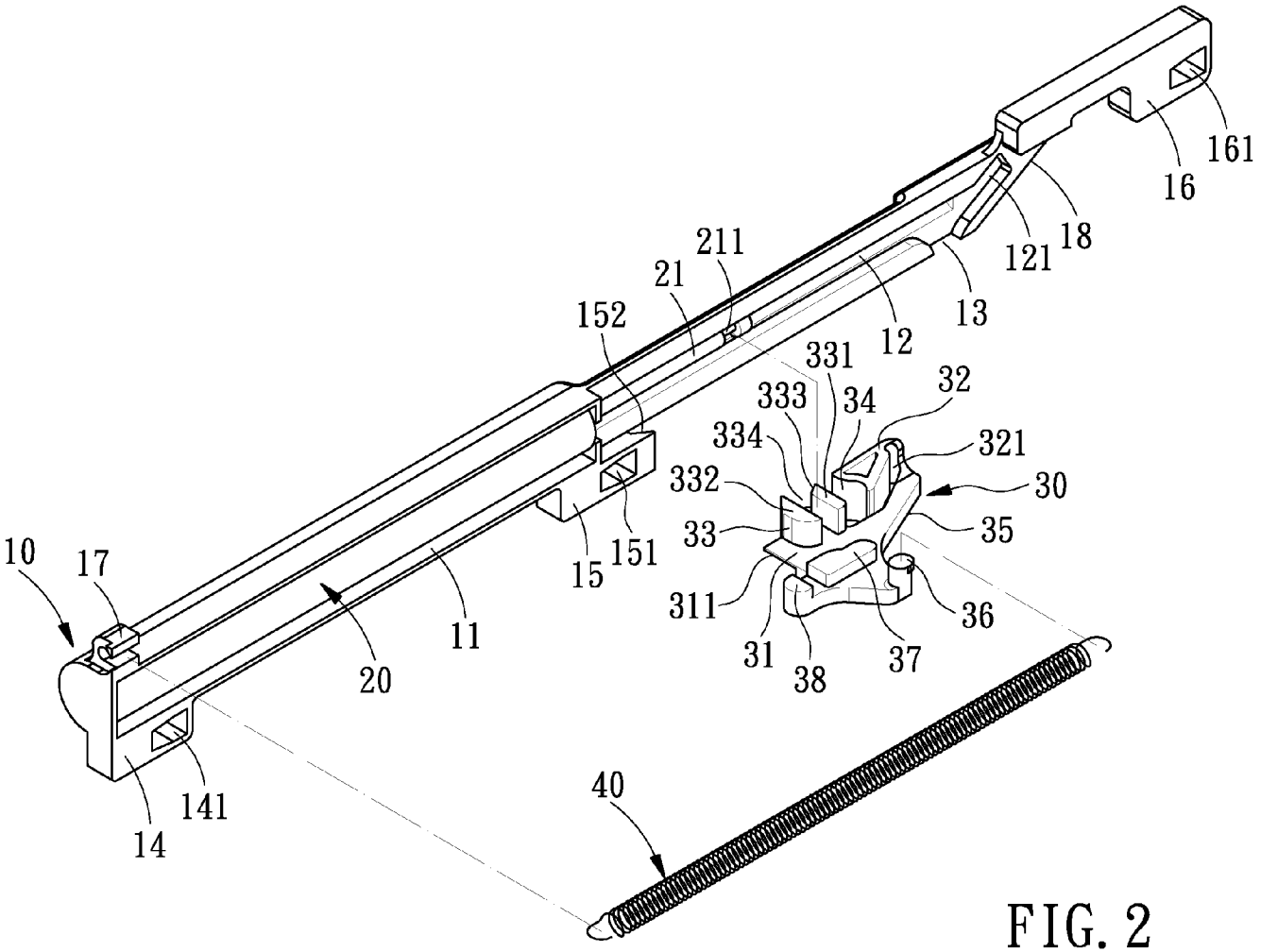
FIG. 2 is an exploded view of a hidden self-closing drawer slide assembly in accordance with the present invention.
Figure 3:
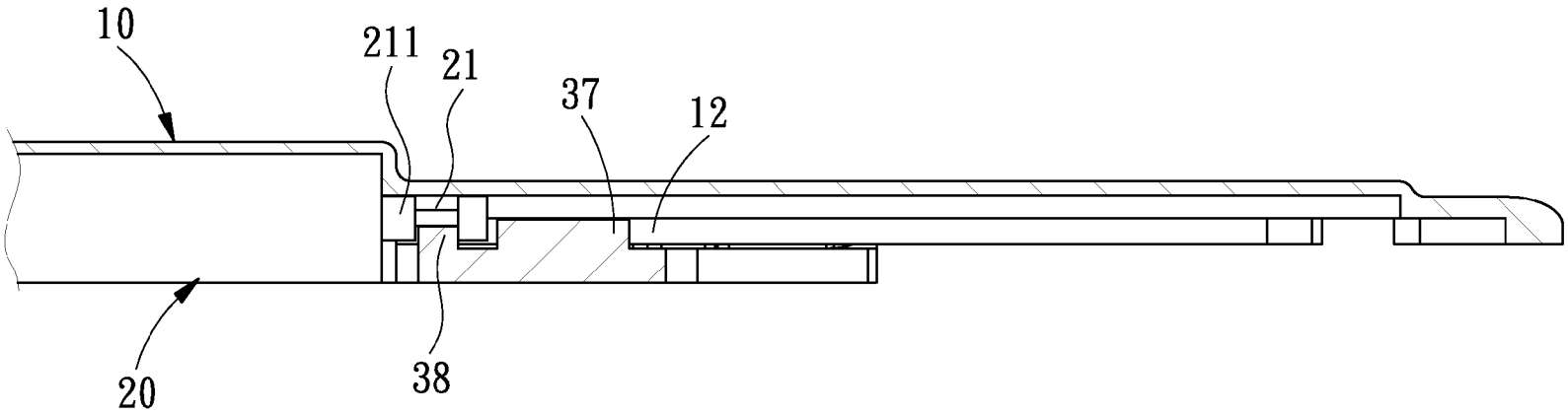
FIG. 3 is an assembly cross sectional view of the hidden self-closing drawer slide assembly in accordance with the present invention.

The present invention will be clearer from the following description when viewed together with the accompanying drawings, which show, for purpose of illustrations only, the preferred embodiment in accordance with the present invention.

Referring to FIGS. 2-5, a hidden self-closing drawer slide assembly in accordance with a preferred embodiment of the present invention is mounted on a stationary rail A and used together with a slide rail B. The slide rail B slidably mounted on the stationary rail A is provided at one side thereof with a driving pin B1 and connected to a drawer. The self-closing drawer slide assembly comprises: a base 10, a pressure cylinder 20, a traction member 30 and a spring 40.

The base 10 is formed with a receiving chamber 11 for accommodation of the pressure cylinder 20 and a slide groove 12 in communication with the receiving chamber 11. One end of the slide groove 12 away from the receiving chamber 11 is folded into a positioning portion 121 which is formed with an opening 13 located at one edge of the base 10. At the edge of the base 10 where the opening 13 is located are formed a first positioning block 14, a second positioning block 15 and a third positioning block 16 which are defined with a locking hole 141, 151, 161, respectively. The first positioning block 14 is located close to the receiving chamber 11 of the base 10, and the third positioning block 16 is located close to the positioning portion 121 of the slide groove 12. The second positioning block 15 is located at an outer surface of a joint between the receiving chamber 11 and the slide groove 12 and provided with a protruding slantwise stop surface 152. Another edge of the base 10 opposite the first, second and third positioning blocks 14, 15, 16 is formed with a protruding hook 17. The base 10 is further provided with a slantwise surface 18 which is located close to the third positioning block 16.

The pressure cylinder 20 is received in the receiving chamber 11 of the base 10 and is provided with a retractable piston rod 21, and one end of the retractable piston rod 21 extending out of the pressure cylinder 20 is formed with a concave locking portion 211.

The traction member 30 includes a flat board 31 connected to a locking block 32, between the flat board 31 and the locking block 32 is defined a cutting groove 321 which makes the locking block 32 elastically deformable and foldable with respect to the flat board 31. The flat board 31 is formed with a driving portion 33 beside the locking block 32. The driving portion 33 includes a first restricting protrusion 331 and a second restricting protrusion 332. The first restricting protrusion 331 is located close to the locking block 32 and includes a slantwise guiding surface 333. Between the first and second restricting protrusions 331, 332 is a first locking space 334, and between the locking block 32 and the driving portion 33 is a second locking space 34. The flat board 31 includes a slantwise edge 35 and a pin 36 beside the slantwise edge 35. On the flat board 31 is disposed a guiding block 37, and the edge of the flat board 31 adjacent to the guiding block 37 extends outward to form a locking protrusion 38. The traction member 30 is mounted on the base 10 in such a manner that the guiding block 37 is movably received in the slide groove 12 of the base 10, and the locking protrusion 38 is engaged in the locking portion 211 of the piston rod 21 of the pressure cylinder 20, so that the guiding block 37 drives the pressure cylinder 20 to extend out or retract back. The slide of the guiding block 37 within the slide groove 12 makes the pin 36 protrude out of the edge of the base 10 where the hook 17 is located, and makes the locking block 32 and the driving portion 33 protrude out of another opposite edge of the base 10. The flat board 31 is provided with a downward slantwise stop surface 311 which is to be abutted against the slantwise stop surface 152 of the second positioning block 15 of the base 10.

The spring 40 has two ends hooked to the hook 17 of the base 10 and the pin 36 of the traction member 30 and stretches when being pulled by the traction member 30.

Figure 4:
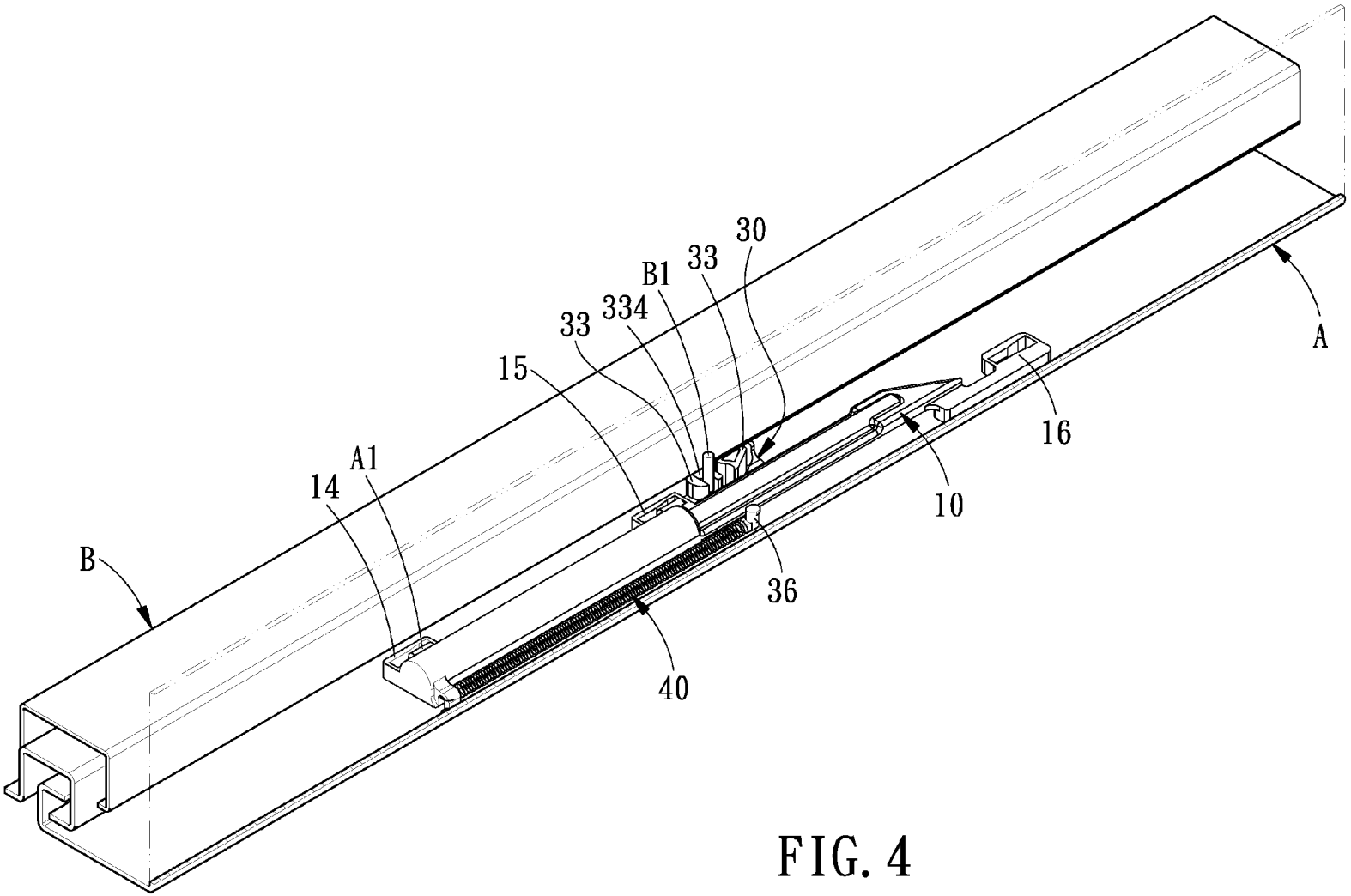
FIG. 4 is an illustrative view showing the hidden self-closing drawer slide assembly in accordance with the present invention.
Figure 5:
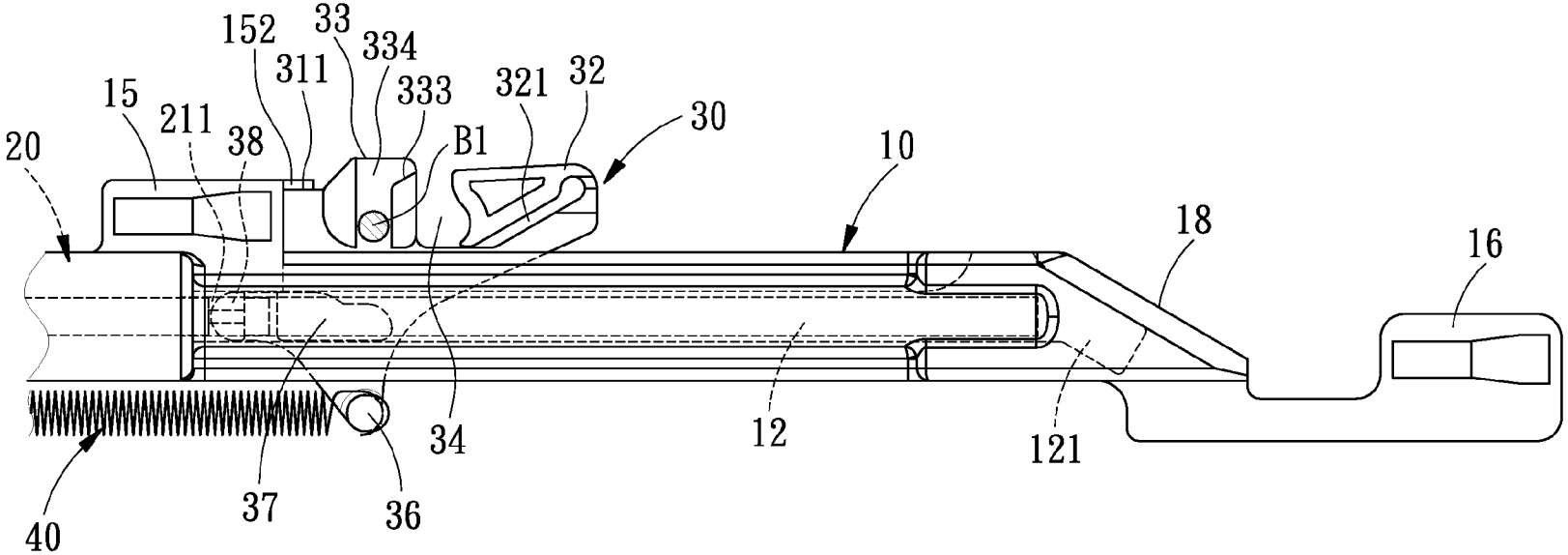
FIG. 5 is an illustrative view showing the hidden self-closing drawer slide assembly before being pulled.
Figure 6A:
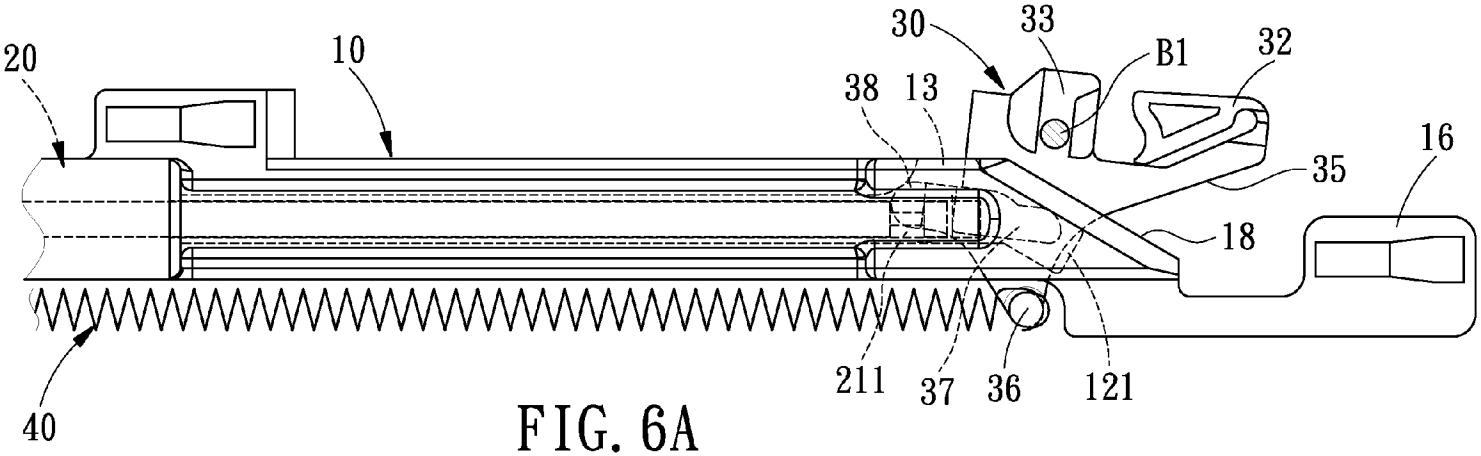
FIG. 6A is an illustrative view showing the hidden self-closing drawer slide assembly after being pulled but not being engaged.
Figure 6B:
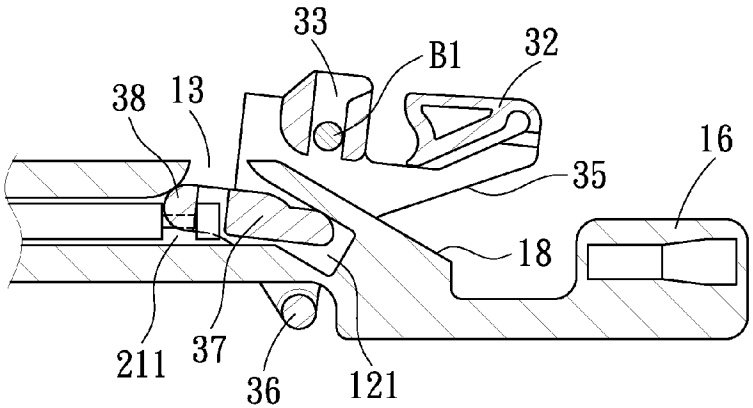
FIG. 6B is a partial amplified cross sectional view of FIG. 6A, showing a locking protrusion of a traction member being engaged in a locking portion of a piston rod of a pressure cylinder.
Figure 7A:
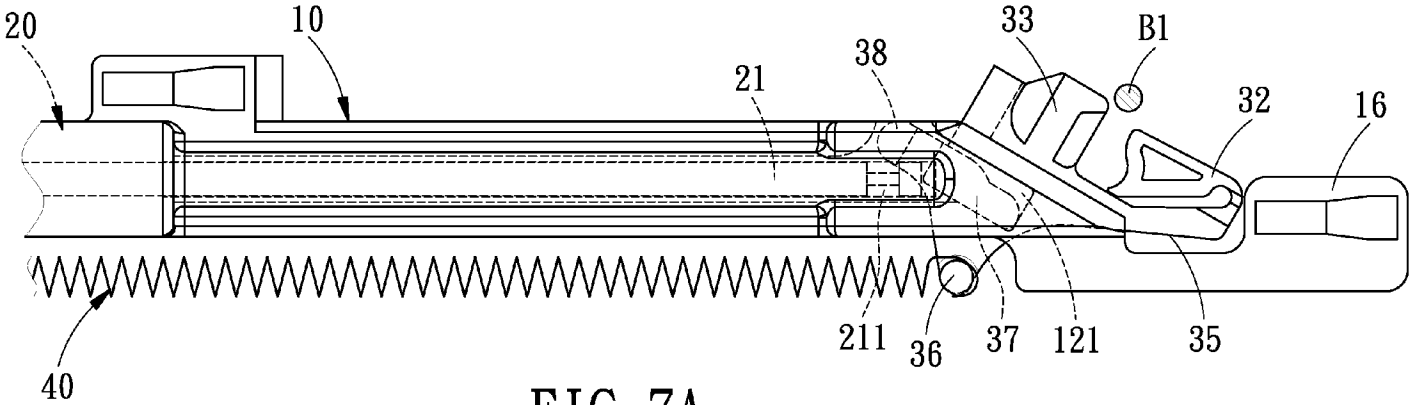
FIG. 7A is an illustrative view showing the hidden self-closing drawer slide assembly after being pulled and engaged.
Figure 7B:
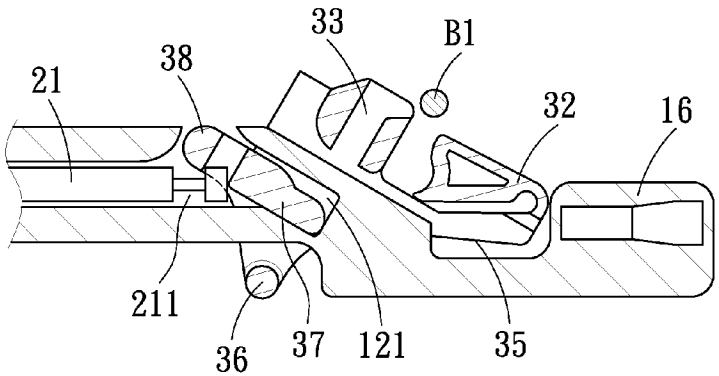
FIG. 7B is a partial amplified cross sectional view of FIG. 7A, showing the locking protrusion of the traction member being disengaged from the locking portion of the piston rod of the pressure cylinder.

The structural relations of the components of the hidden self-closing drawer slide assembly in accordance with the present invention are described as above. Referring then to FIGS. 4 and 5, the stationary rail A is provided with three positioning protrusions A1 for engaging with the locking hole 141, 151, 161 of the first, second and third positioning blocks 14, 15, 16, respectively, so that the base 10 can be positioned on the stationary rail A. The slide rail B is slidably disposed on the stationary rail A in such a manner that the driving pin B1 of the slide rail B is received in the first locking space 334 of the driving portion 33 of the base 10, so that when the slide rail B slides along the stationary rail A, the driving pin B1 can drive the traction member 30 to slide along the base 10, causing stretching of the spring 40. When the slide rail B is caused to move outward when the drawer is being pulled by a user, and the guiding block 37 of the traction member 30 slides along the slide groove 12 to the positioning portion 121 of the base 10, as shown in FIGS. 6 and 7, when the user keeps pulling the slide rail B, the slide rail B will continue driving the traction member 30, and the guiding block 37 of the traction member 30 will slide through the folding portion of the slide groove 12 and finally into the positioning portion 121. When the guiding block 37 is pivoted into the positioning portion 121, the locking protrusion 38 of the traction member 30 will pivot and extend out of the opening 13, and the traction member 30 will disengage from the concave locking portion 211 of the piston rod 21 of the pressure cylinder 20, so that the traction member 30 is completely disconnected from the pressure cylinder 20. Meanwhile, the locking protrusion 38 is engaged in the opening 13 of the base 10, the spring 40 is stretched by the traction member 30, and the slantwise edge 35 of the traction member 30 is pivoted toward the slantwise surface 18 of the base 10, such that the driving portion 33 is pivoted into a disengaged position at which the driving portion 33 is disengaged from the driving pin B1 and the drawer is pulled out.

When the drawer is pushed back by the user, the driving pin B1 of the slide rail B will be moved along the slantwise guiding surface 333 of the first restricting protrusion 331 into the first locking space 334 of the driving portion 33 of the traction member 30, so that the driving pin B1 is capable of driving the traction member 30 to move. When the user continues pushing the drawer, the guiding block 37 of the traction member 30 will be disengaged out of the positioning portion 121 of the slide groove 12 of the base 10, and the locking protrusion 38 will be locked into the locking portion 211 of the piston rod 21 of the pressure cylinder 20. At this moment, the traction member 30 can be pushed by the spring 40 to move toward the pressure cylinder 20, meanwhile, the traction member 30 also drives the piston rod 21 to move back into the pressure cylinder 20, bringing the drawer back to the closed position. When the drawer returns back, the spring 40 provides a force for pushing the drawer back, while the pressure cylinder 20 provides a buffering effect to absorb the shock and noise caused during the back movement of the drawer.

Figure 8:
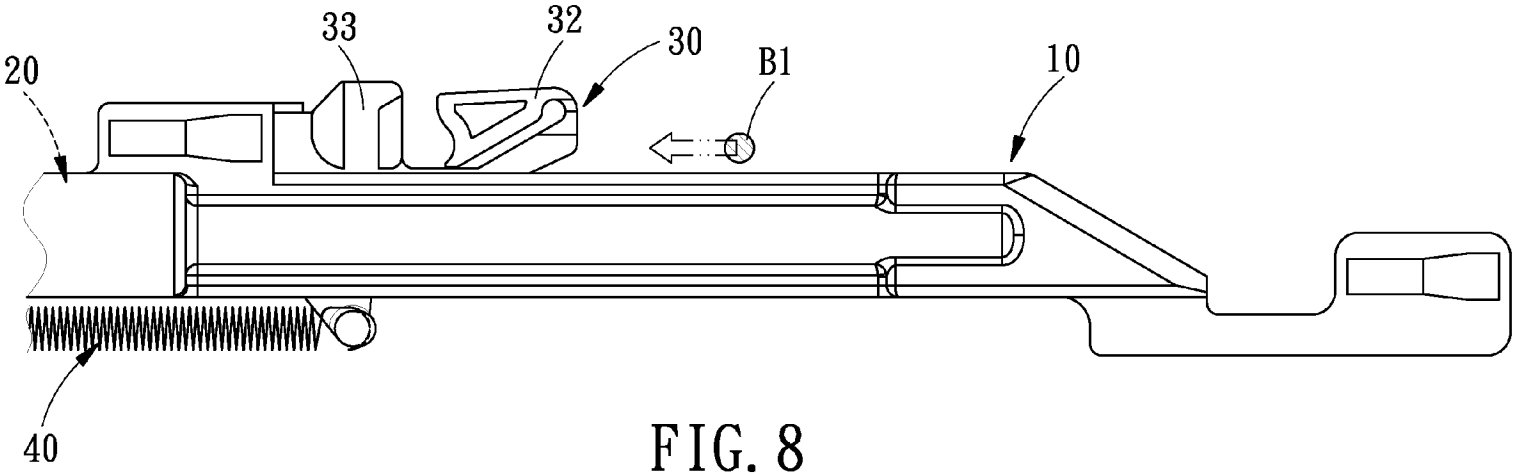
FIG. 8 is an illustrative view showing the hidden self-closing drawer slide assembly being disengaged from a driving pin of a slide rail.
Figure 9:
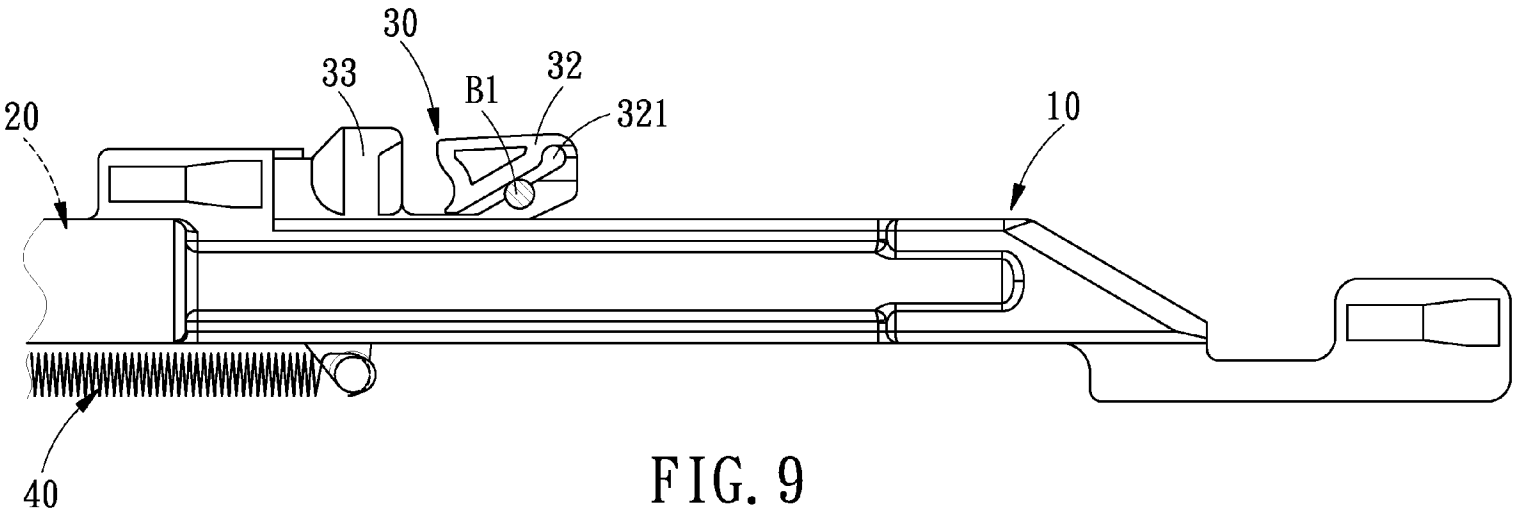
FIG. 9 is an illustrative view showing the driving pin of the slide rail contacts a locking block of the hidden self-closing drawer slide assembly.
Figure 10:
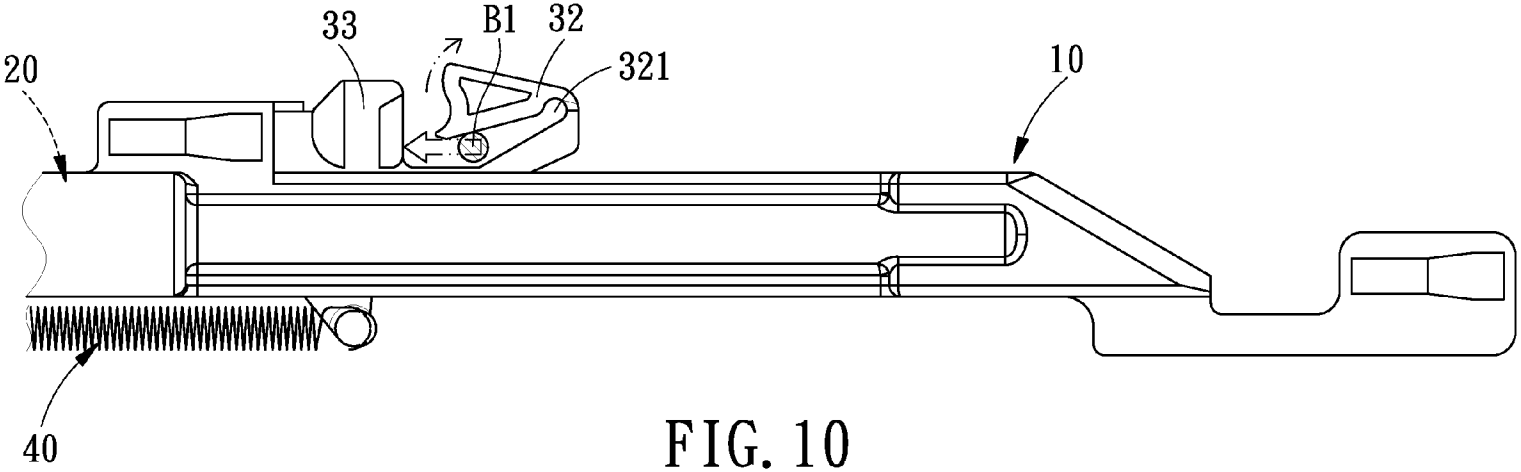
FIG. 10 is an illustrative view showing the driving pin of the slide rail pushes the locking block and causes it fold outward.
Figure 11:
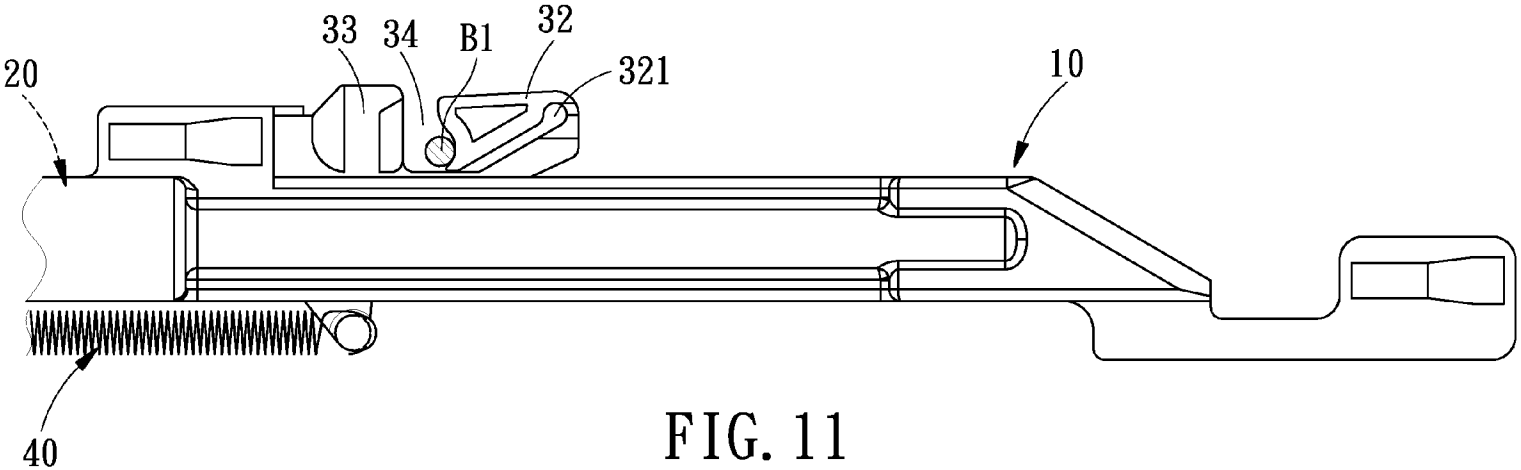
FIG. 11 is an illustrative view showing the driving pin of the slide rail being locked between the locking block and the driving portion.

The abovementioned is the normal operation of the hidden self-closing drawer slide assembly. However, sometimes, when the user pushes the drawer, the traction member 30 might be disengaged from the positioning portion 121 of the base 10 when being impacted, and the driving pin B1 fails to engage in the first locking space 334 of the traction member 30, as shown in FIG. 8, at this moment, the traction member 30 will be pushed back by the spring 40 to its original position, leaving the slide rail B in a pulled-out position. To make the slide rail B return back to its original non-pulled-out position, all the user needs to do is to continue pushing the drawer until the driving pin B1 contacts the locking block 32. As shown in FIG. 9, since the locking block 32 is elastically deformable and foldable, the driving pin B1 will push the locking block 32, causing the locking block 32 to fold outward, and then the driving pin B1 will move along the cutting groove 321 of the locking block 32 into the second locking space 34 between the locking block 32 and the driving portion 33, as shown in FIGS. 10 and 11. When the driving pin B1 is engaged in the second locking space 34, it is able to drive the traction member 30 to move. When the traction member 30 is engaged in the positioning portion 121 of the base 10 again, and the driving pin B1 of the slide rail B is pushed into the first locking space 334 again, the slide rail B returns back to its original non-pulled-out position at which is drawer is closed.

While we have shown and described various embodiments in accordance with the present invention, it is clear to those skilled in the art that further embodiments may be made without departing from the scope of the present invention.

What is claimed is:

1. A hidden self-closing drawer slide assembly comprising:

a base formed with a receiving chamber and a slide groove in communication with the receiving, chamber, one end of the slide groove away from the receiving chamber being folded into a positioning portion, an edge of the base being formed with a protruding hook;

a pressure cylinder received in the receiving chamber of the base and provided with a retractable piston rod, the retractable piston rod extending out of the pressure cylinder and slidably received in the slide groove of the base, and one end of the retractable piston rod extending out of the pressure cylinder being formed with a concave locking portion;

a traction member including a flat board formed with a driving portion which consists of a first restricting protrusion and a second restricting protrusion, between the first and second restricting protrusions being formed a first locking space, on the flat board being disposed a guiding block and a pin, and an edge of the flat board adjacent to the guiding block extending outward to form a locking protrusion, the traction member being mounted on the base in such a manner that the guiding block is movably received in the slide groove of the base, and the locking protrusion is engaged in the locking portion of the piston rod of the pressure cylinder; and a spring with two ends hooked to the hook of the base and the pin of the traction member, respectively;

wherein the hidden self-closing drawer slide assembly is mounted on a stationary rail and used together with a slide rail, the slide rail slidably mounted on the stationary rail is provided at one side thereof with a driving pin and connected to a drawer, and the driving pin is to be engaged in the first locking space of the traction member.

2. The hidden self-closing drawer slide assembly as claimed in claim 1, wherein an opening is formed at the edge of the base and located at a folded portion of the slide groove.

3. The hidden self-closing drawer slide assembly as claimed in claim 1, wherein a first positioning block, a second positioning block and a third positioning block which are defined with a locking hole, respectively, are formed at another edge of the base where an opening is located, the stationary rail is provided with three positioning protrusions for engaging with the locking hole of the first, second and third positioning blocks, respectively.

4. The hidden self-closing drawer slide assembly as claimed in claim 3, wherein the second positioning block is located at an outer surface of a joint between the receiving chamber and the slide groove and provided with a protruding slantwise stop surface, the flat board is provided with a downward slantwise stop surface which is to be abutted against the slantwise stop surface of the second positioning block of the base.

5. The hidden self-closing drawer slide assembly as claimed in claim 3, wherein the first positioning block is located close to the receiving chamber of the base, the third positioning block is located close to the positioning portion of the slide groove, the base is further provided with a slantwise surface which is located close to the third positioning block, the flat board includes a slantwise edge beside the pin, the slantwise edge of the traction member is pivoted toward the slantwise surface of the base.

6. The hidden self-closing drawer slide assembly as claimed in claim 1, wherein the traction member is connected to a locking block which is located beside the driving portion of the flat board, between the flat board and the locking block is defined a cutting groove which makes the locking block elastically deformable and foldable with respect to the flat board, and between the locking block and the driving portion is a second locking space.

7. The hidden self-closing drawer slide assembly as claimed in claim 6, wherein the first restricting protrusion of the traction member is located close to the locking block and includes a slantwise guiding surface.

* * * * *